United States Patent [19]

Hahn et al.

[11] 4,322,210

[45] Mar. 30, 1982

[54] AUXILIARY, AND PROCESS, FOR THE SOAKING OF HIDES

[75] Inventors: Erwin Hahn, Heidelberg; Dietrich Lach, Friedelsheim; Rolf Streicher, Worms, all of Fed. Rep. of Germany

[73] Assignee: BASF Aktiengesellschaft, Ludwigshafen, Fed. Rep. of Germany

[21] Appl. No.: 176,684

[22] Filed: Aug. 8, 1980

[30] Foreign Application Priority Data

Sep. 20, 1979 [DE] Fed. Rep. of Germany ..... 2938078

[51] Int. Cl.[3] ..... C14C 1/04; C14C 1/08

[52] U.S. Cl. ..... 8/94.18; 8/94.16; 252/8.57

[58] Field of Search ..... 8/94.16, 94.18; 252/8.57

[56] References Cited

U.S. PATENT DOCUMENTS

| | | | |
|---|---|---|---|
| 2,225,601 | 12/1940 | Pfannmuller | 8/94.16 |
| 3,567,363 | 3/1971 | Wolfram | 8/94.16 |
| 4,175,922 | 11/1979 | Eckert et al. | 8/94.16 |

FOREIGN PATENT DOCUMENTS

| | | | |
|---|---|---|---|
| 614142 | 6/1978 | U.S.S.R. | 252/8.7 |

OTHER PUBLICATIONS

Chem. Abstract, vol. 76, 1453562z, (1972).

*Primary Examiner*—Maria Parrish Tungol
*Attorney, Agent, or Firm*—Oblon, Fisher, Spivak, McClelland & Maier

[57] ABSTRACT

An auxiliary for the soaking of hides and skins, which consists of a salt of the formula I $$M^+[O_3S—S—R]^- \qquad \text{I}$$

where R is an organic radical of 1 to 8 carbon atoms, which may carry one or more functional groups, and $M^+$ is one equivalent of a cation, mixtures thereof with other conventional soaking auxiliaries, and processes for their use. Using the novel auxiliary avoids all toxicity hazards and odor nuisance, as well as avoiding oxidation losses, and achieves good loosening of the hair.

12 Claims, No Drawings

AUXILIARY, AND PROCESS, FOR THE SOAKING OF HIDES

The soaking of hides serves various purposes in leather manufacture. First, it is intended to restore the hides to their condition after flaying, ie. dried or salted hides should, after the soak, again have roughly the original water content. In the case of salted hides, the soak should also substantially free the hides from salt. Furthermore, the soak is intended to remove soiling such as dung, blood, soluble albumins and fats from the hides. However, the soak is also intended to prepare the hide for the subsequent liming. This means that the pH in the soak should be from 8 to 10 over the entire cross-section of the hide, so as to prevent any lime draw resulting from an excessive change in pH. At the same time, however, a certain degree of hair loosening should be achieved even in the soak, so that the hair should detach more quickly and more completely in the lime.

Such a preliminary hair loosening gives cleaner pelts after liming. Nowadays this is particularly important, for two reasons: first, pelts are no longer smoothed, for cost reasons, and secondly equipment such as mixers have been used for some years, and these have only a slight drumming action and hence only incompletely remove the slime during liming.

Various methods of soaking are provided in the prior art. In the simplest case, only water is used. This necessitates very long soak times, and presents a rotting hazard. The use of small amounts of acid or, preferably, of alkali brings an improvement. Alkalis have the advantage that the pH of the hides is thereby brought closer to that of the lime. Furthermore, they produce partial hydrolysis of fat and albumin. A further improvement consists in the additional use of surfactants since they accelerate wetting and disperse the soiling materials. To prevent rotting, bactericides are added, especially in warm countries. To accelerate the loosening of hair, it has already been proposed to add small amounts of liming chemicals, eg. sodium sulfide ($Na_2S$), sodium bisulfide (NaHS), dimethylamine, thioglycolic acid or mercaptoethanol, to the soaking liquor. These chemicals have the following disadvantages: the first three are toxicologically unsafe, since they can evolve hazardous gases under the pH conditions of the soak, and on further processing. The two last-mentioned chemicals are on the one hand oxidation-sensitive and on the other hand can cause considerable odor nuisance if the pH of the soaking liquor is close to the neutral point.

It is an object of the present invention to provide a soaking auxiliary and a process for the soaking of hides, which meets all the requirements, described at the outset, of a soak, in particular including a certain degree of hair loosening, and which does not suffer from the disadvantages mentioned, ie. is devoid of sensitivity to oxidation, is non-toxic and does not cause odor nuisance.

We have found that this object is achieved by providing an auxiliary, or mixture of auxiliaries, and a soaking process, as defined in the claims.

It is surprising that the hair loosening is achievable with an organic compound which contains neither mercapto groups nor amino groups.

The compounds of the formula I can easily be prepared by reacting a thiosulfate with an appropriate reactive organic compound, for example in accordance with, or similarly to, the following equations:

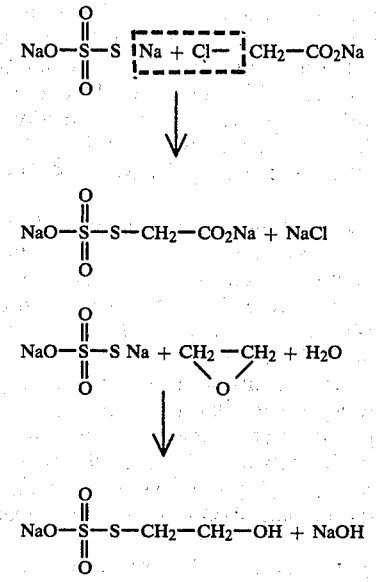

The reaction products of sodium thiosulfate with chloroacetic acid and with ethylene oxide are particularly preferred. In principle, however, numerous other organic compounds can be reacted with thiosulfate to form a substance of the general formula I, for example propylene oxide, 1,2-n-butylene oxide, chloroacetonitrile, 3-chloropropionitrile, 2-chloropropionitrile, 2-chloroacetamide, 2-chloropropionamide, 3-chloropropionamide, ethyl chloride, n-propyl chloride, iso-propyl chloride, n-octyl bromide, benzyl chloride, maleic anhydride, 3-chloropropionic acid, 2-chloropropionic acid, acrylic acid, crotonic acid and $\beta$-chloroethanol.

The radical R in formula I can accordingly be an aliphatic or araliphatic radical of up to 8 carbon atoms, and this radical can be substituted by one or more carboxyl, carboxylate, hydroxyl, nitrile and/or amide groups. $M^+$ in formula I is one equivalent of a cation, ie., for example, $K^+$, $NH_4^+$, $\frac{1}{2}$ $Mg^{++}$, $\frac{1}{2}$ $Ca^{++}$ or, preferably, $Na^+$.

The conventional soaking conditions are used, ie. liquor lengths of from 200 to 1,000% of water, based on dry weight of hide or skin, temperatures of from 15° to 40° C., preferably from 20° to 35° C., and soak times of from 6 to 100, preferably from 6 to 48, hours, depending on the nature of the hide.

In addition to the actual novel hair-loosening agent of the formula I, the novel soaking auxiliary mixture, which is also claimed, contains surfactants and bactericides and may contain water. Non-ionic and cationic surfactants are preferred. Examples of conventional non-ionic surfactants are the numerous commercially available ethylene oxide adducts and propylene oxide adducts, as well as mixed adducts (which are mostly not random adducts but block adducts) with monofunctional, difunctional and polyfunctional alcohols, amines, polyamines, aminoalcohols, carboxylic acids, acid amides and alkylphenols, as well as block copolymers of ethylene oxide and propylene oxide, ethylene oxide and butylene oxide or ethylene oxide, propylene oxide and butylene oxide. The conventional cationic surfactants include fatty amine salts and quaternary ammonium compounds.

The bactericides used are preferably commercial quaternary ammonium salts, since these have particularly low toxicity and, because of their surfactant character, assist the soaking action. Examples include benzyltrimethylammonium chloride, didecyldimethylammonium chloride, 3,4-dichlorobenzyl-trimethylammonium chloride and the compounds mentioned by M. H. Angele in "SeifenÖle-Fette-Wachse" 104 (1978), 433–478.

The soaking liquor contains from 0.01 to 0.4%, preferably from 0.05 to 0.3%, based on dry weight of hides, of the novel active ingredient of the formula I. In the soaking auxiliary mixture claimed, the weight ratio of compound I:surfactant:bactericide is 1:(0.5–10):(0.1–5), preferably 1:(0.6–6):(0.3–3). The bactericides having a surfactant effect are, for this purpose, counted only as bactericides and not as surfactants.

The advantages of the soaking auxiliary according to the invention are, in particular, the insensitivity to oxidation and hence greater economy in use, the toxicological safety and the absence of odor of the compounds of the formula I.

In the Examples, parts and percentages are by weight, and are based on dry weight of hides and skins, unless stated otherwise or unless it is obviously not the case.

Where salted hides and skins are used, the salted weight is, as usual, to be taken to be 2.5 times the dry weight, ie. if based on salted weight instead of dry weight, the amounts mentioned are to be divided by 2.5.

EXAMPLE 1

Two halves of a salted cowhide, each of 25 parts by weight, are first rocked for 20 minutes in liming tubs filled with 200% of water at 28° C., then left to stand for 20 minutes and then rocked again for 20 minutes. The water is then drained off. The following are then added to the piece referred to as A: 150% of water at 28° C., 0.5% of sodium carbonate and 0.5% of a soaking auxiliary (I) which consists of 10 parts of sodium carboxymethylene-thiosulfate, 30 parts of a commercial propylene oxide/ethylene oxide block polymer prepared by reacting a propylene oxide block of molecular weight 1,750 with 150 moles of ethylene oxide, 10 parts of benzyltrimethylammonium chloride and 50 parts of water. The following are added to the piece referred to as B: 150% of water at 28° C., 0.5% of sodium carbonate and 0.5% of a soaking auxiliary (II) which consists of 30 parts of the above propylene oxide/ethylene oxide block polymer, 10 parts of benzyltrimethylammonium chloride and 60 parts of water. Both A and B are then rocked for 60 minutes and thereafter for 5 minute periods every 30 minutes over a total period of 16 hours; finally, the liquors are drained off. Both halves are clean, but the hair is substantially easier to remove from piece A than from piece B.

After both halves have been fleshed, they are conjointly limed in 50% of water at 28° C. by means of 2.5% of 60% strength commercial sodium sulfide and 4% of calcium hydroxide. After 2 hours' rocking, the liquor is lengthened with 50% of water at 30° C. and the pieces of hide are then rocked for 10 minute periods every 30 minutes, over a total period of 18 hours. The liquor is then drained off and the pelts are washed twice for 20 minutes with 300% of water at 24° C. Pelt A is substantially cleaner than pelt B.

EXAMPLE 2

The two halves A and B of a dried cowhide, each of 8 parts by weight, are treated as follows: piece A is rocked for 18 hours in a liming tub in 1,000% of water at 30° C., with the addition of 1% of sodium carbonate and 1.5% of the auxiliary referred to as I in Example 1. Piece B is soaked in exactly the same manner but using auxiliary II instead of I. After completion of the soak, the hair is substantially easier to remove from piece A than from piece B. After fleshing, the pieces are limed as described in Example 1. Piece A is substantially paler than piece B.

In Examples 3–5, the procedure followed is similar to Example 1, except that the sodium carboxymethylene-thiosulfate in the soaking auxiliary is replaced by other compounds of the formula I. The details are shown in Table 1.

TABLE 1

| Example No. | Compound of the formula I |
|---|---|
| 3 | $NaO_3S_2—CH_2—CO—NH_2$ |
| 4 | $NaO_3S_2—CH_2—CN$ |
| 5 | $NaO_3S_2—C_2H_4—OH$ |

The results obtained after soaking and liming correspond to those of Example 1.

In the Examples which follow, the procedure employed is similar to Example 2, except that the composition of the soaking auxiliary, and the amount used, are varied as shown in Table 2.

TABLE 2

| Example No. | Compound of the formula I | Surfactant | Bactericide | Amount of soaking auxiliary employed |
|---|---|---|---|---|
| 6 | 27.8 parts of $NaO_3S_2—CH_2—CO_2Na$ | 16.7 parts of polyethylene glycol, molecular weight about 400 | 55.5 parts of benzyltrimethyl-ammonium chloride | 1.0% |
| 7 | 20 parts of $NaO_3S_2—CH_2—CO_2Na$ | 70 parts of polyethylene glycol, molecular weight about 600 | 10 parts of didecyldimethyl-ammonium chloride | 0.6% |
| 8 | 10 parts of $NaO_3S_2—CH_2—CO—NH_2$ | 60 parts of an adduct of tallow alcohol with about 80 moles of ethylene oxide | 30 parts of benzyltrimethyl-ammonium chloride | 0.8% |
| 9 | 10 parts of $NaO_3S_2—CH_2—CO—NH_2$ | 80 parts of an adduct of nonylphenol with about 6 moles of ethylene oxide | 10 parts of didecyldimethyl-ammonium chloride | 0.8% |
| 10 | 10 parts of $NaO_3S_2—CH_2—CH_3$ | 60 parts of an adduct of tallow alcohol with about 80 moles of ethylene oxide | 30 parts of benzyltrimethyl-ammonium chloride | 1.0% |
| 11 | 30 parts of $NaO_3S_2—(CH_2)_7—CH_3$ | 60 parts of an adduct of nonylphenol with about | 10 parts of didecyldimethyl- | 0.4% |

TABLE 2-continued

| Example No. | Compound of the formula I | Surfactant | Bactericide | Amount of soaking auxiliary employed |
|---|---|---|---|---|
| | | 6 moles of ethylene oxide | ammonium chloride | |

The results after soaking and liming correspond to Example 1.

We claim:

1. A mixture for soaking hides and skins comprising:
(a) a salt of formula I $$M^+[O_3S—S—R]^- \quad (I)$$

wherein R is an aliphatic or araliphatic radical of 1 to 8 carbon atoms which may be unsubstituted or may be substituted with one or more carboxyl, carboxylate, hydroxyl, nitrile, or amide functional groups and $M^+$ is a cation;
(b) a surfactant; and
(c) a bactericide.

2. The mixture of claim 1 wherein said radical is substituted with 1 or more of said functional groups.

3. The mixture of claim 1, wherein M is sodium.

4. The mixture of claim 1, where R is $—CH_2—COONa$ or $—CH_2—CH_2OH$.

5. The mixture of claim 1, wherein the surfactant is a conventional non-ionic or cationic surfactant.

6. The mixture of claim 1, wherein the weight ratio of the components a:b:c is 1:(0.5–10):(0.1–5).

7. A method of soaking hides and skins which comprises contacting said hides and skins with an auxiliary agent comprising a salt of the formula I $$M^+[O_3S—S—R]^- \quad (I)$$

wherein R is an aliphatic or araliphatic radical of 1 to 8 carbon atoms which may be unsubstituted or may be substituted with one or more carboxyl, carboxylate, hydroxyl, nitrile, or amide functional groups and $M^+$ is a cation.

8. The method of claim 7 wherein said radical is substituted with 1 or more of said functional groups.

9. A process for soaking salted or dried hides and skins by keeping these for from 6 to 48 hours in an aqueous liquor at 15°–40° C., with a liquor length of from 200 to 1,000%, based on dry weight, wherein from 0.01 to 4%, again based on dry weight of hides and skins, of a soaking salt of the formula $$M^+[O_3S—S—R]^-$$

is added to the liquor, wherein R is an aliphatic or araliphatic radical of 1 to 8 carbon atoms which may be unsubstituted or may be substituted with one or more carboxyl, carboxylate, hydroxyl, nitrile, or amide functional groups and $M^+$ is a cation;

10. The process of claim 9, wherein M is sodium.

11. The process of claim 9, wherein R is $—CH_2—COONa$ or $—CH_2—CH_2OH$.

12. The process of claims 9, 10 or 11 wherein a surfactant, with or without a bactericide, each in conventional amount, is introduced into the liquor in addition to the soaking salt.

* * * * *